United States Patent [19]

Shen

[11] Patent Number: 4,459,779

[45] Date of Patent: Jul. 17, 1984

[54] FIXED ABRASIVE GRINDING MEDIA

[75] Inventor: John C. S. Shen, Rochester, Minn.

[73] Assignee: International Business Machines Corporation, Armonk, N.Y.

[21] Appl. No.: 418,948

[22] Filed: Sep. 16, 1982

[51] Int. Cl.[3] ..... B24D 3/32

[52] U.S. Cl. ..... 51/296; 51/298

[58] Field of Search ..... 51/296, 298

[56] References Cited

U.S. PATENT DOCUMENTS

| | | | |
|---|---|---|---|
| 3,773,480 | 11/1973 | Hall et al. | 51/296 |
| 3,850,589 | 11/1974 | Charvat | 51/296 |
| 4,011,063 | 3/1977 | Johnston | 51/296 |
| 4,138,228 | 2/1979 | Hartfelt et al. | 51/296 |
| 4,221,572 | 9/1980 | Torimae et al. | 51/296 |
| 4,264,337 | 4/1981 | Fenster et al. | 51/296 |
| 4,331,453 | 5/1982 | Dau et al. | 51/296 |
| 4,343,910 | 8/1982 | Busch et al. | 51/296 |

FOREIGN PATENT DOCUMENTS

| | | | |
|---|---|---|---|
| 257100 | 2/1963 | Australia | 51/296 |

*Primary Examiner*—James H. Derrington

*Attorney, Agent, or Firm*—Robert W. Lahtinen

[57] ABSTRACT

The grinding media is formed of a concentration of agglomerate free hard particles exceeding 50 percent by weight of the media, wherein the particles are chelated by a dispersing agent, surface treated with a surfactant, mixed with polyether polyol and polyisocyanate plus a catalyst and water and thereafter rapidly cured in a closed mold which has been preheated to a temperature exceeding 50° C. and a pressure of 60 to 120 PSIG. The water reacts during curing to create a polyurea linkage and release $CO_2$ as a blowing agent. The resulting media has a low elastic modulus with particles retained in a polyurethane-urea binder system. The media composition may also include an inorganic filler such as glass fibers not exceeding 30 percent by weight of the media.

4 Claims, 3 Drawing Figures

POLYURETHANE

POLYUREA

FIXED ABRASIVE GRINDING MEDIA

BACKGROUND OF THE INVENTION

As magnetic recording track densities and bit densities increase, it is necessary to enhance the precision of the accessing and transducer mechanism such as the reduction of the head fly height. As the fly height is reduced, signal output is enhanced; however, lower fly height characteristics are unavailing if the cooperating storage media does not achieve similar higher levels of performance such as the flatness of the magnetic media surface. The commonly used method of preparing a metal magnetic disk substrate is to diamond turn and then fine polish. The diamond turn process is not economical and does not improve the geometry of substrates. One alternative method of replacing diamond turning is grinding. Grinding information handling disk metallic substrates differs from the conventional grinding of metal pieces. A more precise technique is required to produce flat, scratchless disk surfaces prior to polishing. These requirements prevent conventional grinding media from meeting the performance criteria.

SUMMARY OF THE INVENTION

This invention teaches a composition of fixed abrasive media which has demonstrated the capability of producing a flat scratchless disk surface before polishing. In accordance with the present invention, the disk substrate is ground using a rigid, high density, incompressible polyurethane-urea foam which impregnates classified hard particles in a concentration exceeding 50 percent by weight. This is a fixed abrasive grinding media with the classified hard particles ideally of the 35 micron size and not exceeding 50 microns. It is important that the particles be captured as a fixed abrasive by the polyurethane-urea binder and be uniformly dispersed. During the grinding process the abrasive particles gradually disintegrate rather than breaking away from the binder. It is also important that the rigid binder be friable to produce an aggressive cutting action. It is also important that the binder system has a low modulus of elasticity to eliminate any deep scratches during the grinding. Also this binder system is able to stand high pressure without dimensional distortion. Dimensional stability under the required grinding pressure is key to achieving the necessary flatness.

and

Figure 2A:
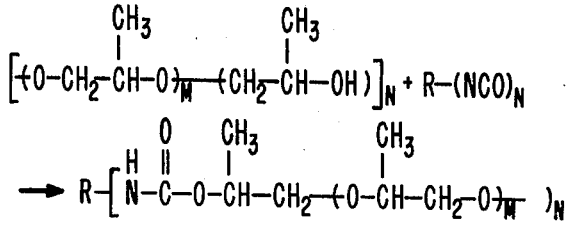
FIG. 2*a* shows the polyether polyol isocyanate reaction to form a urethane linkage.
Figure 2B:
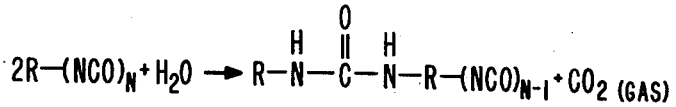

FIG. 2*b* shows the water isocyanate reaction which forms a urea linkage.

DETAILED DESCRIPTION

The fixed abrasive grinding media of this invention includes a polyurethane-urea binder system in which abrasive particles are dispersed. The binder system includes a catalyst, a surfactant, a dispersant and a blowing agent to enhance the properties of the binder system component material.

The polyisocyanate compounds used in the binder of the present invention have a molecular weight of 120 to 160 per NCO group. Also the isocyanate has at least three reactive sites, NCO groups, per chain. The polyisocyanate should also have low acidity, that is contain less than 0.1 percent hydrochloric acid (HCl) by weight. The lower acidity is important, since the acidity could retard the reaction which is critical in this process. The polyol compounds which are most readily used to form the binder are polyether type polyols. These are hydroxy terminated compounds which react with the isocyanate to form the highly rigid, thermosetting polyurethane binder. It has been found that the hydroxy terminated polyether polyols should be in liquid form and should have a viscosity not greater than 4,000 centipoises (CPS) at room temperature. In addition it has been found the polyol component should have a molecular weight that is within the range of 140 to 200 per hydroxy reactive site. Also the polyol compound must have two or more reactive hydroxy sites per chain. The ratio of isocyanate NCO reactive sites to hydroxy reactive sites is one factor controlling the properties such as friability of the media. In this formulation, the NCO/OH ratio is in the range of 1.0 to 1.5.

Catalysts used in this invention can be tertiaryamine type catalysts, such as 2, 4, 6 tris (dimethylaminomethyl) phenol, commercially known as DMP 30 (Rohm and Haas). The amount of catalyst used in this formulation is also critical with a required concentration of 1.5 percent or more based upon total binder weight. The dispersing agent serves to chelate the abrasive particles such that they are uniformly suspended within the binder. Examples are titanate coupling agents commercially known as KR-112S, KR-212, and KR55 (Kenrich Petrochemicals). The required concentration of dispersing agent is 0.5 to 1.0 percent by weight of the abrasive particles. The surfactant provides cell structure control which is important in controlling the media aggressiveness or cutting power as well as producing the required smooth surface. The binder system requires a concentration of silicon surfactant which is 1.0 to 3.0 percent by weight of the total binder system.

The blowing agent used in this formulation is carbon dioxide ($CO_2$) gas rather than the conventional fluorocarbon. The $CO_2$ gas is formed by the reaction of polyisocyanate with water, at elevated temperatures. Using water to generate the carbon dioxide ($CO_2$) blowing agent not only controls the density, but also gives a rigidity and non-compressibility to the media. The effect of the use of water on the chemistry of the binder system is shown in FIGS. 2*a* and 2*b*. FIG. 2*a* shows the typical isocyanate reaction with polyether polyol to form a polyurethane. FIG. 2*b* illustrates the isocyanate reaction with water to form a polyurea. The adoption of water in the binder gives rise to a mixture of polyurethane and polyurea in the cured binder system. The combination of polyurethane and polyurea produces the unique structure of grinding media. The water required in this formulation is less than 0.1 percent by weight of the binder system. It has been found that the degree of compressibility can be controlled by incorporating a small amount of isopropyl alcohol. This is important for grinding applications that do not require high pressure during grinding. Grinding media containing a small amount of isopropyl alcohol in the concentration of 0.1 to 0.5 percent by weight of the binder system provided an improved substrate or metal disk surface finish after grinding.

Figure 1:
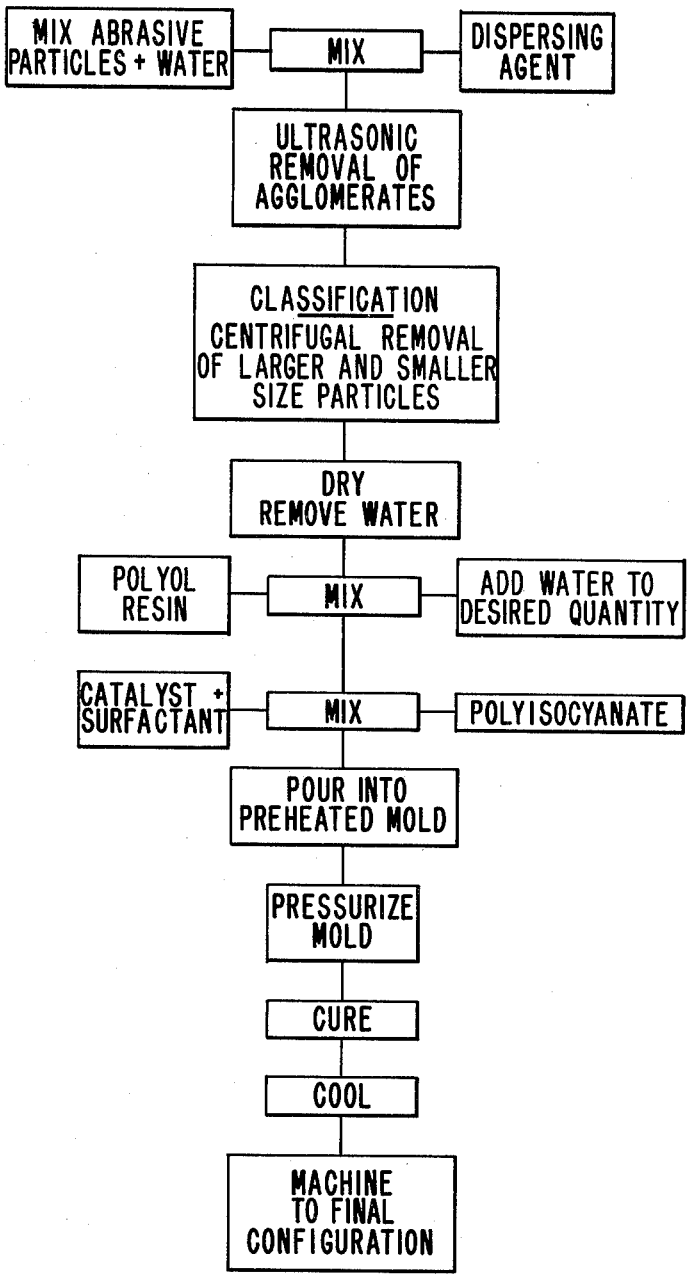
FIG. 1 is a flow chart illustrating the preparation of the abrasive particles and the fabricating of the grinding media.

As shown in the flow diagram of FIG. 1, classified abrasive particles are mixed with water. A dispersing agent is added to the mixture to chelate and uniformly suspend the particles using one or more of the following types of dispersing equipment—high speed mixer, homogenizer, micrionizer, and/or ultrasonic disperser. Abrasive particles such as aluminum oxide, silicon carbide or a combination can be used. An effective grinding media should have abrasive particle loading equal to 50 percent by weight and preferably 60 percent by weight or greater. The particles should not exceed 50 microns in size with the preferred size being within the range of 20 to 40 microns.

Any agglomerates that exist in the mixture through failure of the particles to successfully uniformly disperse are ultrasonically removed, and the mixture is then centrifically classified to assure not only that there are not particles having a size in excess of 50 microns, but also to confine the particle size to the 20 to 40 micron size range.

Although water is one of the reagents to be present when the binder system is cured, the mixture of particles is dried to remove the water introduced during the initial mixing steps so that the water subsequently added can be in the specific quantity required for the subsequent processing.

The dried, classified and dispersed particle mixture is mixed with the polyether polyol resin and the water that will function as a co-reactant to produce a gaseous blowing agent. To this mixture the catalyst, surfactant and polyisocyanate are added. The final mixture of particles and binder system are poured into the cavity of a mold preheated to a temperature of 40° to 70° C. which is closed, pressurized to 60 to 120 pounds per square inch (psi) and placed in an oven maintained at a temperature of 150° to 200° C. for 15 minutes.

The combined effect of the catalyst, mold temperature and pressure must cause a quick reaction. More specifically the liquid binder system must reach the cream stage at which the liquid no longer pours in 10 seconds and must solidify in an additional 50 seconds. Thus the binder system is cured from liquid to solid in 1 minute or less. This speed of reaction is necessary to produce a solid grinding media that is free of flow patterns and the irregularities in physical properties that are associated therewith. The remainder of the 15 minute duration in the elevated temperature oven is provided to assure a complete cure of the binder material throughout the thickness of the media. The completed molded part is then removed from the mold and cooled by quenching in a water bath at a temperature of 10° C. or below for 5 minutes. In the last fabricating operation, the molded part is machined to the final desired configuration.

Tests and evaluations made of the grinding media formed by the process and of the materials in this description show that this grinding media has a low modulus of elasticity, in the range of 0.1 to 1.0 $KN/mm^2$ (kilo-newtons per millimeter square). All other grinding media that have been evaluated or tested have had a modulus of elasticity in the range of 6.0 to 60 $KN/mm^2$. No known grinding media has a modulus less than 1.0 $KN/mm^2$. The grinding media described herein is capable of aggressive grinding action to provide fast stock removal with required surface finish, that is, no surface scratches greater than 30 microinches peak to valley. This is attained using high loading and high density.

EXAMPLE I

| Ingredient | Parts by Weight |
|---|---|
| Polyisocyanate | 50.0 |
| Polyether polyol | 50.0 |
| Abrasive particles aluminum oxide (20–40 microns) | 150.0 |
| Titanate coupling agent Dispersant KR-11ZS | 0.5 |
| Silicon copolymer Surfactant DC190 | 1.0 |
| Catalyst, DMP 30 | 1.8 |
| Water | 0.5 |

The 150 parts of abrasive particle were first dispersed in polyether polyol with dispersant using a high speed agitator until a uniform mixture was achieved. The above materials are mixed together with surfactant and water for two minutes. After introducing the polyisocyanate and catalyst the material is mixed for 10 seconds and placed in the closed mold which has been preheated to a temperature in the range of 40° to 70° C. The mold is maintained under a pressure of 60 to 120 PSIG and cured in an oven at a temperature of 150° C. for 15 minutes, then quenched in a cool water at a temperature of 10° C. or below for 5 minutes.

EXAMPLE II

| Ingredient | Parts by Weight |
|---|---|
| Polyisocyanate PAPI 135 (Upjohn) | 50.0 |
| Polyether polyol Voranol RH 360 (Dow) | 50.0 |
| 35 micron aluminum oxide | 150.0 |
| Titanate coupling agent, KR-212 dispersant | 0.5 |
| Silicon copolymer surfactant, DC 193 | 1.0 |
| Catalyst DMP 30 | 1.8 |
| Water | 0.5 |

EXAMPLE III

| Ingredient | Parts by Weight |
|---|---|
| Polyisocyanate | 50.0 |
| Polyol | 50.0 |
| 35 micron silicon carbide | 150.0 |
| Titanate coupling agent, KR-212 Dispersant | 0.5 |
| Catalyst, DMP 30 | 1.8 |
| Water | 0.5 |
| Isopropyl alcohol | 0.1 |
| Silicon copolymer Surfactant, DC 193 | 1.0 |

EXAMPLE IV

| Ingredient | Parts by Weight |
|---|---|
| Polyisocyanate | 50.0 |
| Polyol | 50.0 |
| 35 Micron Silicon Carbide Abrasive particles | 150.0 |
| Titanate coupling agent, Dispersant KR-212 | 0.5 |
| Silicon copolymer Surfactant, DC 193 | 1.0 |
| Catalyst, DMP 30 | 1.8 |
| Water | 0.5 |

-continued

| Ingredient | Parts by Weight |
|---|---|
| Glass fibers, Owens-Corning 731 | 30.0 |

Examples II and III describe differences in abrasive particles while Example IV represents a new type of abrasive pad impregnated with classified abrasive particles and inorganic filler (glass fibers) The reason for the reinforcing fiber is to improve the strength of the pads which will not break apart under high speed rotation during grinding. The glass fibers are 1/16 to ¼ inches in length and 35 to $95\times10^{-5}$ inches in diameter. The fibers used are milled fibers in powdery form such as Owens-Corning 731 and 739.

I claim:

1. The method of fabricating an abrasive grinding media comprising:

mixing classified abrasive particles which have been surface treated with a dispersing agent and from which agglomerates have been removed with multifunction, low viscosity polyether polyol; multi function polyisocyanate; water and a catalyst;

placing the mixture in a mold which has been preheated to 40° to 70° C.;

pressurizing the mold cavity to 60 to 120 pounds per square inch; and curing at a temperature of at least 150° C., whereby a fast reaction occurs at conditions of elevated temperature and pressure to produce a microstructure free of flow patterns with a density in excess of 0.5 gram per cubic centimeter.

2. The method of claim 1 wherein said mixing step further comprises the addition of a surfactant and said curing step occurs at a temperature of from 150° to 200° C.

3. The method of claim 2 further comprising mixing an inorganic filler with said classified abrasive particles in an amount not exceeding 30 percent by weight of the media.

4. The method of fabricating an abrasive grinding media comprising:

mixing classified hard particles in a multifunction polyether polyol and a dispersant until a uniform mixture is achieved;

adding a surfactant and water to said mixture and mixing;

adding a multifunction polyisocyanate and catalyst to said mixture;

placing said mixture in a closed mold that has been preheated to 40° to 70° C.;

curing the binder material at 60 to 120 psig and 150° to 200° C.; and quenching the cured material under cool water at 4° to 10° C.

* * * * *